US008525409B2

(12) United States Patent
Cseh et al.

(10) Patent No.: US 8,525,409 B2
(45) Date of Patent: Sep. 3, 2013

(54) EFFICIENT LAMP WITH ENVELOPE HAVING ELLIPTICAL PORTIONS

(75) Inventors: Geza Zoltan Cseh, Budapest (HU); Ferenc Fazekas, Budapest (HU); Peter Lajos Nagy, Budapest (HU); Laszlo Balla, Kisvarda (HU); Bela Mezei, Kisvarda (HU)

(73) Assignee: General Electric Company, Schenectady, NY (US)

( * ) Notice: Subject to any disclaimer, the term of this patent is extended or adjusted under 35 U.S.C. 154(b) by 220 days.

(21) Appl. No.: 13/159,965

(22) Filed: Jun. 14, 2011

(65) Prior Publication Data

US 2012/0319576 A1 Dec. 20, 2012

(51) Int. Cl.
*H01K 1/50* (2006.01)

(52) U.S. Cl.
USPC ..... 313/579

(58) Field of Classification Search
None
See application file for complete search history.

(56) References Cited

U.S. PATENT DOCUMENTS

| | | | | |
|---|---|---|---|---|
| 4,413,205 | A * | 11/1983 | Ooms | 313/579 |
| 4,535,269 | A * | 8/1985 | Tschetter et al. | 313/579 |
| 4,578,616 | A | 3/1986 | Cardwell, Jr. | |
| 5,045,748 | A | 9/1991 | Ahlgren et al. | |
| 5,146,134 | A * | 9/1992 | Stadler et al. | 313/579 |
| 5,404,069 | A | 4/1995 | Olwert | |
| 5,686,794 | A | 11/1997 | Streppel | |
| 5,962,973 | A * | 10/1999 | Rice | 313/580 |
| 7,759,871 | B2 | 7/2010 | Chowdhury et al. | |
| 2004/0104678 | A1 | 6/2004 | Bigio et al. | |
| 2005/0095946 | A1 * | 5/2005 | Fridrich | 445/29 |
| 2009/0295290 | A1 | 12/2009 | Magai | |
| 2010/0327731 | A1 | 12/2010 | Aurongzeb et al. | |
| 2011/0215718 | A1 * | 9/2011 | Heil et al. | 313/578 |

FOREIGN PATENT DOCUMENTS

| | | | |
|---|---|---|---|
| DE | 202009008919 | U1 | 9/2009 |
| GB | 805881 | A | 12/1958 |
| GB | 2461628 | A | 1/2010 |
| JP | 59130367 | U | 9/1984 |

OTHER PUBLICATIONS

Search Report and Written Opinion from corresponding PCT Application No. PCT/US2012/041841 dated Aug. 6, 2012.

* cited by examiner

*Primary Examiner* — Britt D Hanley
(74) *Attorney, Agent, or Firm* — Pearne & Gordon LLP

(57) ABSTRACT

A lamp includes a light transmissive envelope comprising two spaced apart elliptical portions that together form a hollow interior. The envelope has sealed end portions. Leads are in electrical contact with the filament near the end portions of the envelope for providing power to the lamp. There is a central portion of the envelope that spaces apart the elliptical portions. An electrically conductive filament is disposed in the interior of the envelope. The filament includes coiled-coil portions disposed in the elliptical portions in a coiled-coil shape and a single coil interval portion disposed between the coiled-coil portions at the central portion of the envelope. At least one filament support positions the filament near a center of the envelope. Gas is contained in the interior of the envelope.

24 Claims, 4 Drawing Sheets

EFFICIENT LAMP WITH ENVELOPE HAVING ELLIPTICAL PORTIONS

FIELD OF THE INVENTION

The field of the invention is lamps, in particular, halogen lamps, that have high efficiency. This high efficiency can be brought about by the shape of the envelope of the lamp and the configuration and position of the filament in the lamp.

BACKGROUND OF THE INVENTION

As shown in FIG. 1, in Europe 230-240V line voltage halogen lamps today are in the lower range of the C class range close to the D class range boundary. However, B class efficiency is the most desirable. The application of an infrared reflecting coating to the lamp can improve lamp efficiency, so to reach the B energy class is theoretically possible.

There are several major requirements of the halogen lamp design with infrared (IR) reflecting technology developed to produce higher efficiency halogen lamps. IR reflectivity and visible transmission of the infrared reflecting multilayer should be increased. Bulb and filament shape should be optimized to reflect infrared radiation back to the filament as much as possible. Also, the filament should be maintained in the designed place, namely, in center of the bulb both during manufacturing and throughout its lifetime. Nevertheless, to reach B class is a huge step, even for low wattage lamps, where wire and coil dimensions are small. Small wire and coil size can easily cause the misfit and deformation of the filament during manufacturing and throughout its lifetime.

BRIEF DESCRIPTION OF THE INVENTION

In one embodiment the lamp of this disclosure includes a light transmissive (e.g., glass) envelope comprising two spaced apart, connected elliptical portions that together form a hollow interior. The envelope has sealed end portions. There is a central portion of the envelope that spaces apart the elliptical portions. An electrically conductive filament is disposed in the interior of the envelope. Leads are in electrical contact with the filament near the end portions of the envelope for providing power to the lamp. The filament includes coiled-coil portions disposed in the elliptical portions in a coiled-coil shape and a single coil interval portion disposed between the coiled-coil portions at the central portion of the envelope. That is, the coiled-coil portions of the filament are where a coil of the filament is in turn coiled. The single coil interval portion of the filament is where there is only a single coil in the filament. At least one filament support positions the filament near a center of the envelope. Gas is hermetically sealed in the interior of the envelope.

Referring to specific aspects of the lamp described above, each of the elliptical portions has a major axis and a minor axis, wherein the major axis can be between about 12 mm and 17 mm and the minor axis (mm) can be approximately equal to 1.2*(major axis−5). The central portion of the envelope can be in a shape of a cylindrical tube. The filament support can be made of metal having a high melting point (e.g., above 1800-2000° C.), for example, tungsten or molybdenum. The filament can be designed for a line voltage of 230-240 volts and the lamp can be operated at 25-150 W. An infrared radiation reflecting coating can be disposed on a surface of the envelope. The lamp can be a halogen lamp in which case the gas comprises an inert gas containing halogen. For example, the gas may contain Ar, Kr, Xe, or $N_2$, or combinations thereof as inert gases, and Cl, I, Br or F, or combinations thereof as halogens.

The filament can include single coil interval portions near the end portions of the envelope. The filament support can comprise side filament supports located near each of the end portions of the envelope and a central filament support located at the central portion of the envelope. The envelope can include outer tubular portions near the end portions adjacent and outside of the elliptical portions. The side filament supports can be disposed in the elliptical portions of the envelope, as well as in the outer tubular portions. Each of the side filament supports can be welded to one of the single coil intervals near the end portions of the envelope in close proximity to one of the coiled-coil portions of the filament. The envelope can include pinch portions located near its end portions. The side filament supports can extend within an inner space of the envelope in the elliptical portions and so as not to touch the pinch portions. The side filament supports are separated from the pinch portion, even from the Mo foil in the pinch portion, to prevent high current arcing at end of life, which may cause explosion of the lamp. On the other hand, the inner surface of the pinch portion is curved, which could cause deformation of the filament support during manufacturing.

The filament support can be a foil. The foil can have a thickness ranging from 0.01 to 0.3 mm. Near to the edge of the foil the glass of the envelope can be melted embedding the foil partially. The filament support can comprise a single foil welded to the filament or two foils (or folded single foil) that sandwich the filament therebetween and are welded to the filament. The two foils or folded single foil can also be welded together.

Another embodiment of the lamp of this disclosure includes a light transmissive (e.g., glass) envelope comprising two connected elliptical portions that together form a hollow interior. Each elliptical portion including a major axis and a minor axis, wherein the major axis is between about 12 mm and 17 mm and the minor axis (mm) is approximately equal to 1.2*(major axis−5). An electrically conductive filament is disposed in the interior of the envelope. The envelope includes sealed end portions. Leads are in electrical contact with the filament near the end portions of the envelope for providing power to the lamp. At least one filament support is used for positioning the filament near a center of the envelope. A gas is hermetically sealed in the interior of the envelope.

All of the specific aspects of the lamp of this disclosure discussed above in connection with the first embodiment can apply to this embodiment in any combination. For example, there can be a central (e.g., cylindrical tubular) portion of the envelope between the elliptical portions. The filament can include coiled-coil portions disposed in the elliptical portions in a coiled-coil shape and a single coil interval portion disposed between the coiled-coil portions at the central portion of the envelope. Also, the filament support can include side filament supports near the end portions of the envelope and a central filament support in the central portion of the envelope.

Many additional features, advantages and a fuller understanding of the invention will be had from the accompanying drawings and the detailed description that follows. It should be understood that the above Brief Description of the Invention describes the invention in broad terms while the following Detailed Description of the Invention describes the invention more narrowly and presents specific embodiments that should not be construed as necessary limitations of the invention as broadly defined in the claims.

BRIEF DESCRIPTION OF THE DRAWINGS

Prior Art

FIG. 3(*b*) is a side view of the lamp of FIG. 3(*a*) rotated 90 degrees; and FIG. 3(*c*) is a further enlarged view of a central portion of the envelope, a central filament support and coiled-coil portions of the filament of the lamp shown in FIG. 3(*b*);

FIG. 7(*b*) shows another aspect of the double filament support foil; and FIG. 7(*c*) shows yet another aspect of the double filament support foil.

DETAILED DESCRIPTION OF THE INVENTION

Figure 1:
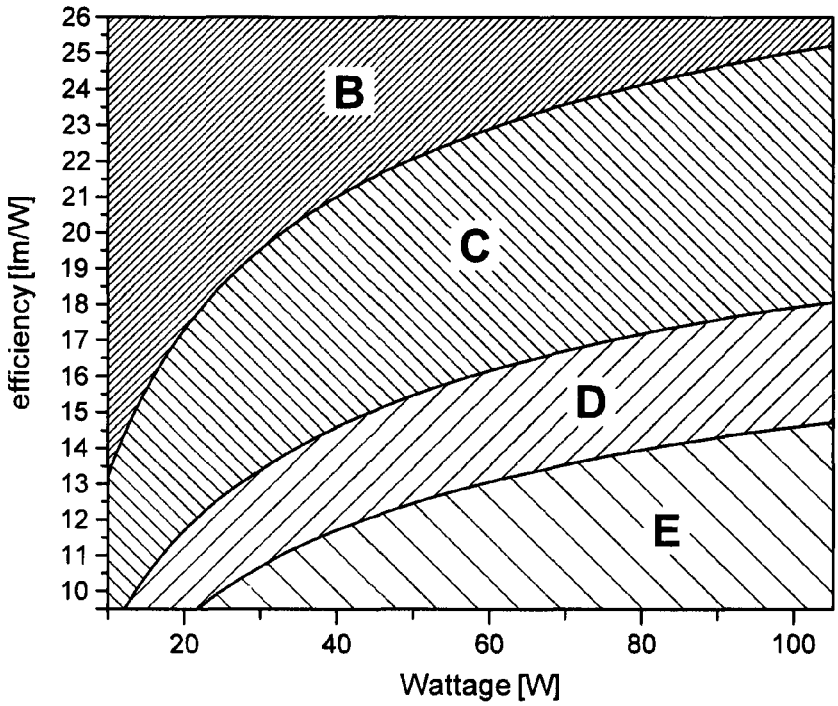
Fig. 1 (Prior Art)
FIG. 1 is a graph showing efficiency of halogen lamps as a function of wattage.
Figure 2:
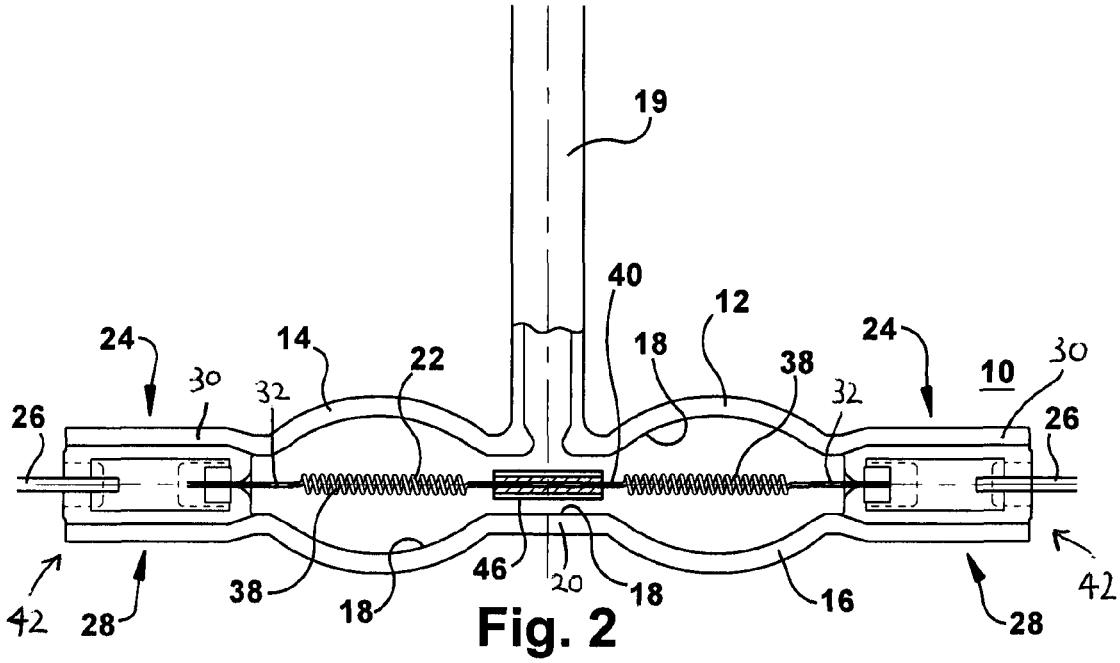
FIG. 2 shows a double ellipse lamp of this disclosure with attached tube for adding fill gas to the lamp.
Figure 3A:
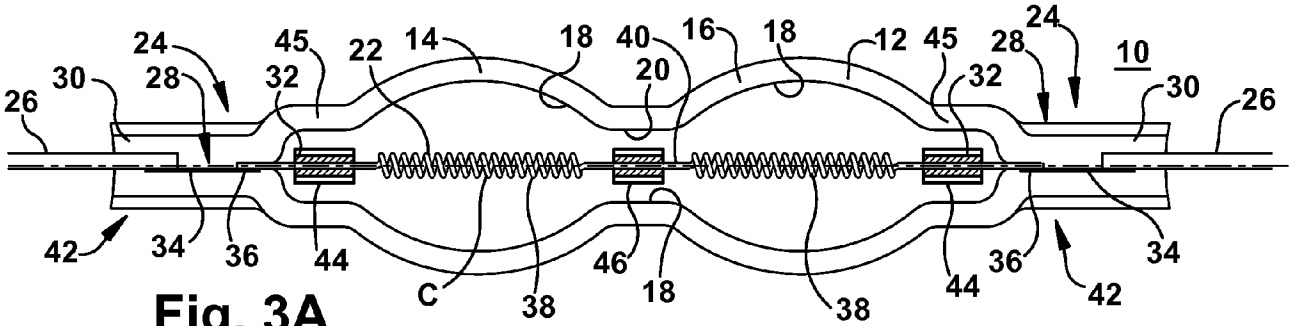
FIG. 3(*a*) is an enlarged side view of a double ellipse lamp of this disclosure after the fill gas tube has been removed.
Figure 3B:
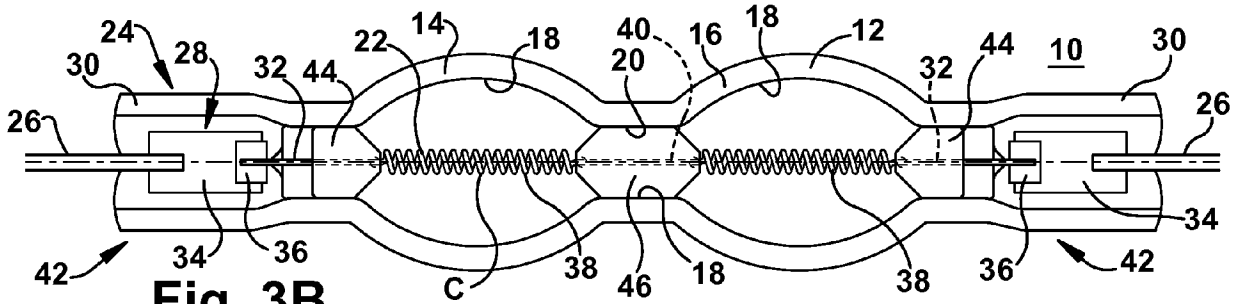
Figure 3C:
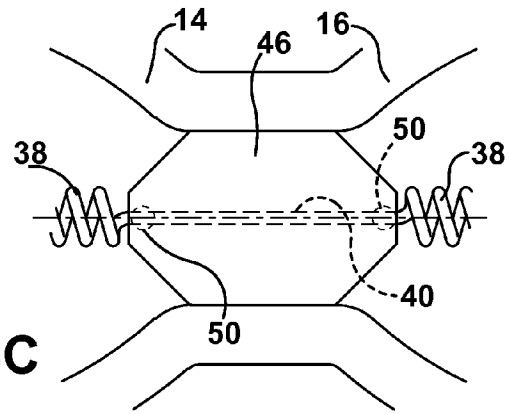

Referring to FIGS. 2 and 3, a lamp 10 of this disclosure includes a heat resistant, light transmissive bulb or envelope 12 having two connected elliptical portions 14, 16 forming a hollow interior 18. The envelope 12 is made of fused or synthetic silica (quartz). The lamp 10 of this disclosure ideally has two elliptical portions 14, 16 in particular, not one, and not three or more. The lamp disclosed here can be used in A-shaped bulbs, spherical shaped bulbs or candle shaped bulbs, for example. The two elliptical bulb portions can be connected with a central cylindrical tubular portion 20, all of which have an IR radiation reflecting coating on their outer surfaces (not shown). The central connecting bulb portion 20 is not distorted with, for example dunching. A fill gas tube 19 is shown centrally located in FIG. 2, but can instead be located between one of the elliptical portions and a pinch portion of the lamp shown in FIG. 3 in which case a longer side filament support 44 and longer tubular portion 45 between the ellipse and pinch portion would be used to receive the exhaust tube. The lamp 10 includes an electric light source or filament 22 in the interior 18 of the double ellipse envelope. The lamp includes a current conductor 24 comprising an outer lead 26, seal foil 28 and the filament 22. The lamp shown in FIG. 2 includes only a central filament support 46 while the lamp shown in FIG. 3 also includes side filament supports 44.

The lamp is hermetically sealed at the end portions of the envelope by pinch portions 30 at which the glass envelope is pressed together closed into flattened cross-sections. The flattened pinch portion 30 is shown in FIG. 2, 3*a* or 3*b*. At each end of the envelope, the welded outer lead 26, seal foil 28 and interval single coil portion 32 of the filament 22 are sealed by quartz of the bulb itself in the pinch portion 30, which is pressed together. The seal foil 28 is known in the art and can be made of a first seal foil 34 welded to the outer lead wire 26 comprising molybdenum, alternatively molybdenum alloy or molybdenum doped with yttrium and/or yttrium oxides. The outer lead wire 26 can be made of molybdenum. An optional second seal foil 36 of tantalum or platinum, for example, is welded to the first seal foil 34 and in turn is welded to the single coil end portion 32 of the filament 22 on both sides of the lamp. The second seal foil 36 can be omitted or replaced by another welding aid besides the second seal foil 36. When the second seal foil 36 is omitted, the single coil end portions are welded to the first seal foil 34. The current conductor 24 connects the filament or electric light source 22 to an external power source.

Figure 7A:
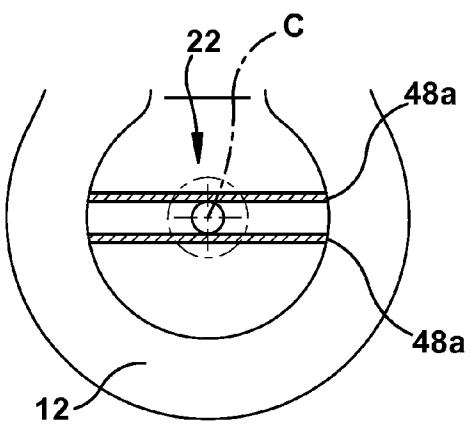
FIG. 7(*a*) shows one aspect of the double filament support foil.
Figure 7B:
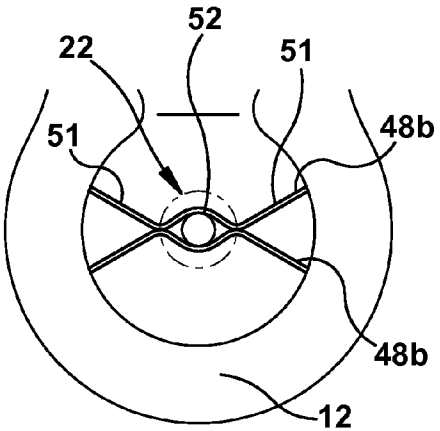
Figure 7C:
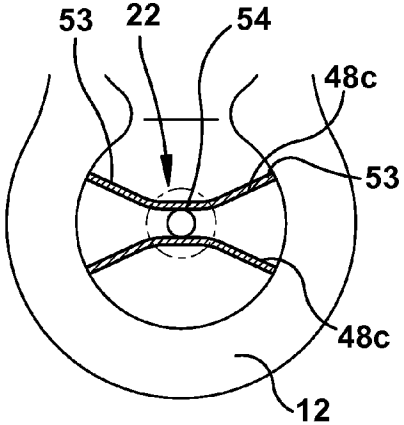

The filament is disposed at a center of the envelope (i.e., close to a central axis extending between the end portions of the envelope in the interior of the envelope and located at a center C of the elliptical portions, represented by the cross C in FIG. 7(*a*) and the line C in FIG. 3(*b*)). The central axis C extends along the major axes, a, of the elliptical portions, the minor axis, b, being perpendicular thereto. There are two coiled coil (CC) portions 38 of the filament 22 separated by a central single coil interval portion 40 of the filament 22. The single coil interval portions 32 of the filament are also disposed at end portions 42 of the envelope 12. The single coil portions 32, 40 are much cooler than the active coiled coil (CC) portions 38 of the filament 22. The CC-portions 38 of the filament 22 function as a burner or radiator that reach an optimum operating temperature and are centered in each elliptical portion 14, 16. The filament 22 can reach temperatures of 2700-3000° C. The filament 22 is suitable for a line voltage of 230-240V, which dictates that the filament have a certain length. This in turn affects the length of the envelope 12 that is needed. The CC portions 38 of the filament 22 are centered in the elliptical portions 14, 16 of the envelope 12. There is an optical coupling of the CC-filament portions 38 between the two elliptical portions 14, 16 through the central portion 20 (e.g., the connecting cylindrical part) of the bulb. The CC portions 38 of the filament 22 are kept in the center by filament supports made from metallic, e.g., tungsten, foil, which include side filament supports 44 and a central filament support 46 therebetween. The central filament support 46 is a foil that fits into the connecting central portion 20. The side filament supports 44 are foils that fit into the end portions 42 of the envelope 12 (e.g., inside tubular portions 45), within the inner space 18 of the lamp. The side filament support foils 44 do not touch the pinch portion 30 from inside. The central filament support foil 46 and the side filament support foils 44 may penetrate to the ellipsoid parts of the bulbs, and are welded to the intervals of the filament as close to the CC part 38 of the filament 22 as possible. The filament support foils 44, 46 may include one or two parts. The double filament support foils 48*a*, 48*b*, 48*c* (FIG. 7(*a*)-(*c*)) (or folded single support foils shown in FIG. 8(*a*)-(*c*)) can provide better centricity of the filament relative to the central axis C of the envelope. The glass of the bulb can be melted to the edge of the filament support foil in a very small area to prevent axial movement of the filament support foils.

In the case of 230-240 line voltage filaments a coiled coil segment 38 of the filament 22, which is the active (radiating) part of the filament, is too long to mount into a single ellipsoid bulb in contrast to 120V filaments. Therefore, the coiled coil (CC) segment 38 is separated into two parts with a central single coiled (SC) segment (interval) 40 in the middle. The two separated active CC parts 38 are mounted to separate ellipsoid parts 14, 16 of the halogen burner (FIG. 2).

Figure 4:
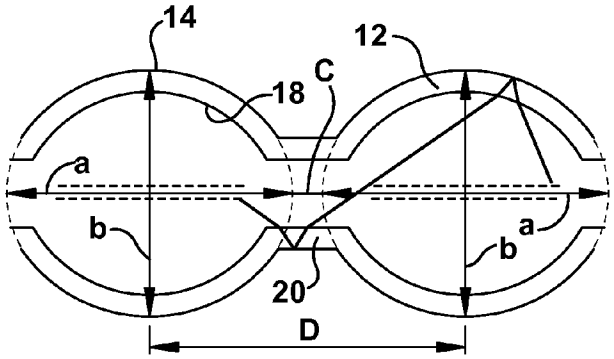
FIG. 4 shows a schematic of optical coupling that can occur between the elliptical portions of the lamp of FIG. 3.

One way to increase the efficiency of the double elliptical design is to increase the ellipse surface, but this is limited by the diameter of the tube from which the bulb is formed. The infrared radiation from the filament to the direction of the open ends of the ellipsoids cannot be reflected back to the filament. Efficiency is increased by optical coupling between the two CC segments through the cylindrical portion of the envelope between the elliptical portions, as shown schematically in FIG. 4. The infrared radiation coming from the first CC segment goes to the second CC segment directly or after one or more reflections on the surface of the connecting central cylindrical portion 20. Although the central portion 20 need not have an exactly cylindrical geometry, a distorted or other irregular surface, e.g. dunching, can destroy this coupling. Therefore, no dunching is used for coil support in this design.

Figure 5:
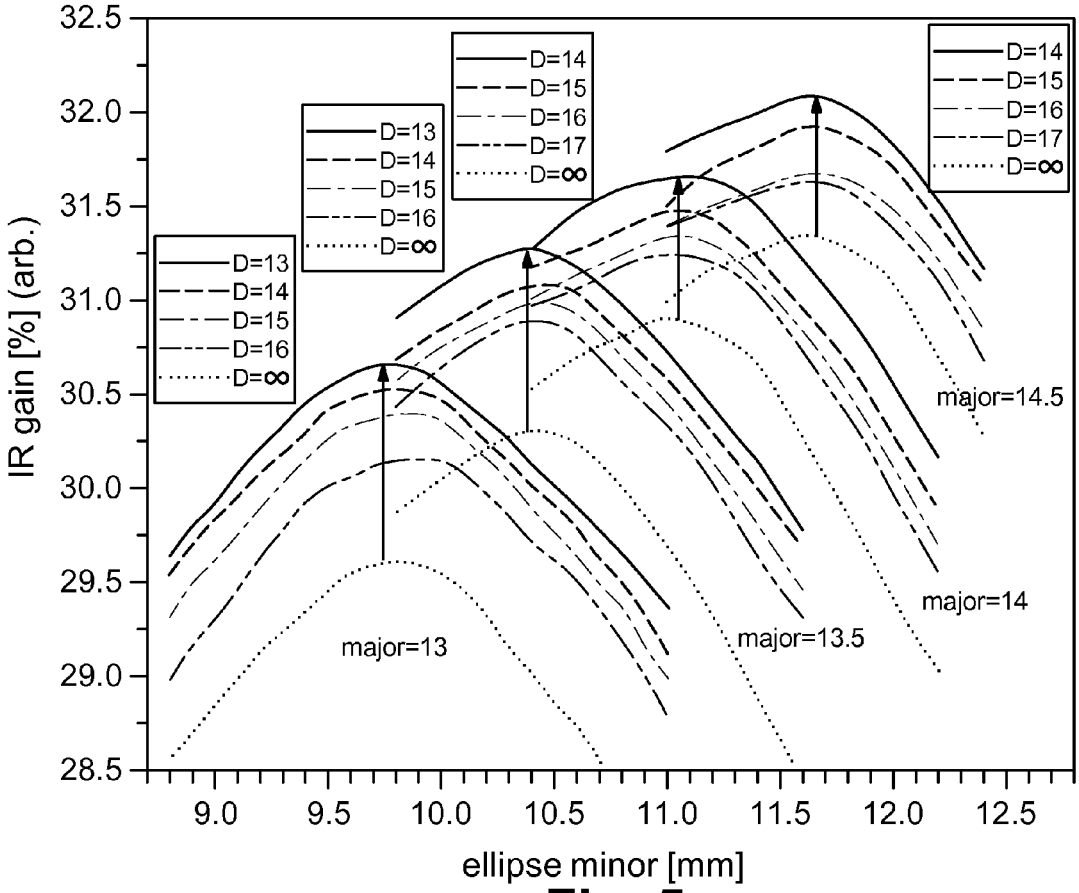
FIG. 5 is a graph showing infrared radiation (IR) gain as a function of the ellipse minor axis and distance between elliptical portions of the envelope D.
Figure 6:
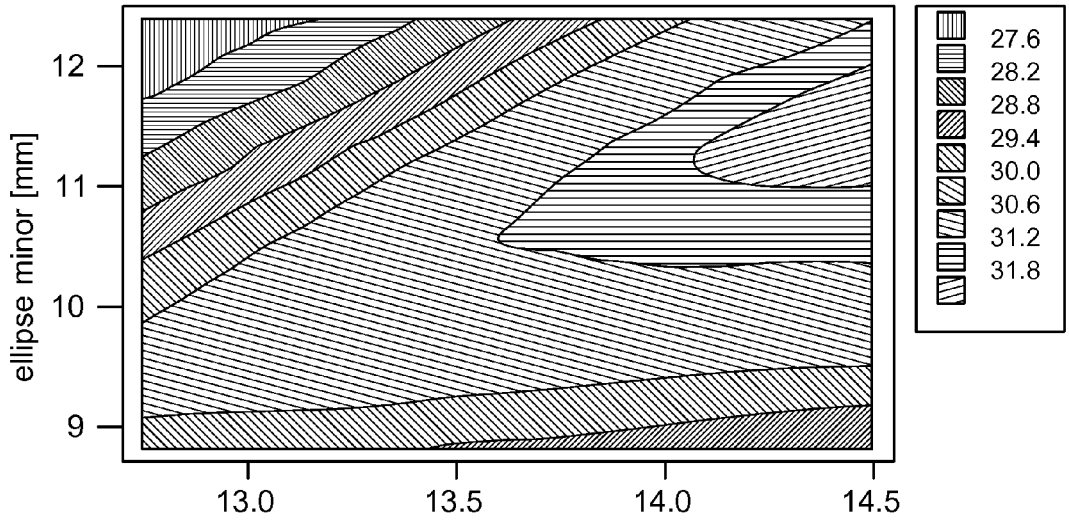
FIG. 6 is a graph showing the ellipse minor axis as a function of the ellipse major axis, and resulting IR gain.

The efficiency increment (IR gain) depends on the ellipse geometry (the major and minor axis), coil geometry, and significantly on the distance between elliptical portions (D, mm) as shown in FIGS. 5 and 6. With decreasing D the IR gain increases, and this effect is higher for smaller ellipsoids. However, D can be only decreased to a point where the two elliptical portions still do not touch each other. In FIG. 5, D=∞ means that there is no optical coupling between two ellipsoids. Otherwise, the central filament support or coil holder 46 cannot be fit between the elliptical portions.

Although many different ellipse geometries are possible, for the usual 230-240 V CC filaments in the 25-150 W wattage range a, the major axis of the elliptical portions 14, 16, ranges between 12 mm and 17 mm. To maximize IR gain the minor axis of the elliptical portions, b, is approximately equal to 1.2*(a−5). The relevant IR gain map is shown in FIG. 6. The target region of the higher IR gain is shown 31.2% and 31.8%. The major axis, a, of the elliptical portions 14, 16 leading to this higher gain ranges from about 13.6 mm to 14.5 mm and above, in particular from about 14.1 to 14.5 and above, and the minor axis, b, of the elliptical portions 14, 16 ranges from about 10.5 mm to about 12 mm and above, in particular from about 10.8 mm to about 11.8 mm and above.

Gain is maximized by keeping the filament 22 in the center of the envelope (along the central axis C of the elliptical portions). Misfit of the filament can occur during manufacturing due to improper coil support design and during burning throughout lifetime due to deformation of the coil caused by gravity force. To resolve both issues, filament coil supports 44, 46 can be made from an appropriately formed metal foil, onto which the intervals 32, 40 are welded at 50 as seen in FIGS. 3 and 7. The circles in FIGS. 7(*a*)-(*c*) show the contour of the coiled coil part of the filament. The CC segments 38 of coil can be kept in the center of the envelope if the filament support 44, 46 is as close as possible to the CC segment (see FIG. 3). The deformation caused by gravity is also much less in this case. The central filament support foil 46 is applied to hold the filament central interval 40 between the two elliptical portions as shown in FIG. 2. A better solution is to use 3 filament supports, one on the central interval, and two on the side intervals as shown in FIGS. 3(*a*) and (*b*). Better center positioning can be achieved if centering foils penetrate into the ellipsoids (e.g., see FIG. 3(*c*)), and the welding points are as close to the CC segment as they can be. This is shown in FIGS. 3(*b*) and (*c*).

The material of the foil is a metal or metallic alloy with high melting temperature (e.g., at least 1800-2000° C.), for example, tungsten or possibly molybdenum. The thickness of the filament support foils 44, 46 can be between 0.01 and 0.3 mm. Single or double foils can be used depending on the centering requirements, but the double foil filament supports (sandwich structure) 48*a*, 48*b*, 48*c* may provide better centricity. Different double foil filament supports are shown in FIG. 7. The foils 48*a* in the "sandwich" can be unshaped and parallel, surrounding the coil interval that has to be supported (FIG. 7(*a*)). When applying shaped foil 48*b* with an axial dip 52 in the middle, the positioning of the coil interval is easier before welding. This also includes portions 51 (on top and bottom) shaped to extend at an angle away from the dip portion 52. In addition, not only can the foil-coil-foil welding be performed, but the two filament support foils 48*c* can be welded to each other at the contacting points (FIG. 7(*b*)). A simple solution, if the foils 48*c* are shaped to have portions 53 extending at an angle away from the center (on top and bottom), but in which there is no dip in the middle 54 for the filament interval, is shown in FIG. 7(*c*)).

Figure 8A:
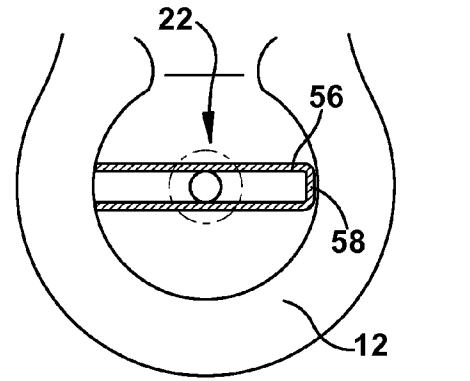
FIGS. 8(*a*)-(*c*) show aspects of a single, folded filament support foil.
Figure 8B:
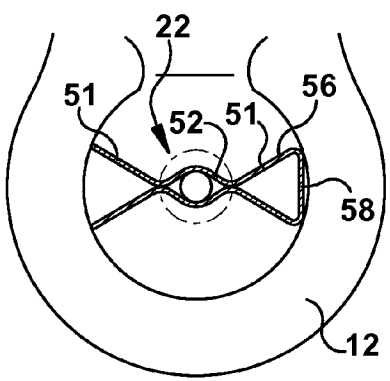
Figure 8C:
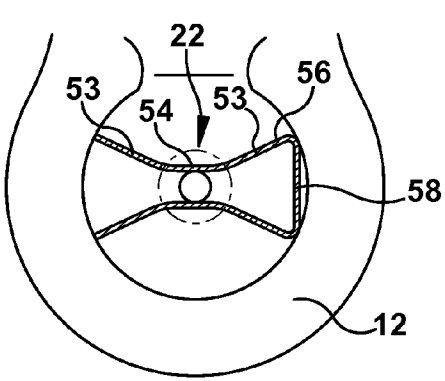

The sandwich foil structure can be made from one piece, if double wide foil is folded in half as shown in FIGS. 8(*a*)-(*c*), which have foil shapes similar to those of FIGS. 7(*a*)-(*c*), respectively. Rather than using two foils, the shapes are achieved using a single wider foil 56 that is folded at fold 58.

To fix the filament support foil 44, 46 in the axial direction, the bulb or envelope glass can be melted onto the edge of the foils in one or more small areas during manufacturing. This can prevent the displacement of the support foils in the axial direction. An advantage of this filament support solution is that it prevents forming a high current arc at end of life, because there are no thick wires required coming into the inner space 18 of the lamp from the pinch portion from the lead wires. In the exemplary design of the lamp shown in the drawings there are two free single coiled parts 32 of the filament at both side of the inner space of the lamp close to the pinch portion (see FIGS. 3(*a*) and (*b*)). These single coiled parts 32 can act as fuses preventing high current surge during burn out of the lamp.

In a conventional halogen lamp, evaporated material of the filament can condense on the inner surface of the envelope causing it to darken. Filament evaporation and envelope darkening results in loss of light or less lamp efficiency. The envelope may be filled with a fill gas which helps to reduce evaporation of the filament, such as an inert gas, e.g., Ar, Kr or Xe or combinations thereof, nitrogen and halogen. One example of the fill gas includes about 5% $N_2$ and about 95% Xe (volume percent) and some halogen. A part of the Xe can be replaced by Kr, e.g. about 65% Xe, 30% Kr. The halogen can be, for example, Br, Cl or I or combinations thereof. Halogens can be filled in very different compounds in gas form or even in liquid. Other components might be added to the fill gas in very small amounts, for example, $O_2$, $H_2$ or other compounds containing Si or P.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. A lamp comprising:

a light transmissive envelope comprising two spaced apart, connected elliptical portions that together form a hollow interior, sealed end portions of said envelope, and a central portion of said envelope that spaces apart said elliptical portions;

an electrically conductive filament disposed in the interior of said envelope, said filament including coiled-coil portions disposed in said elliptical portions in a coiled-coil shape, a single coil interval portion disposed between said coiled-coil portions at said central portion of said envelope and single coil interval portions located near said end portions;

at least one filament support for positioning said filament near a center of said envelope, the at least one said filament support comprising side filament supports located near each of said end portions and a central filament support located at said central portion; and gas contained in the interior of said envelope.

2. The lamp of claim 1 wherein each said elliptical portion includes a major axis and a minor axis, wherein said major axis is between about 12 mm and 17 mm and said minor axis (mm) is approximately equal to 1.2*(major axis −5).

3. The lamp of claim 1 wherein said central portion of said envelope is in a shape of a cylindrical tube.

4. The lamp of claim 1 wherein the at least one said filament support is made of tungsten or molybdenum.

5. The lamp of claim 1 wherein the at least one said filament support is a foil.

6. The lamp of claim 5 wherein said foil has a thickness ranging from 0.01 to 0.3 mm.

7. The lamp of claim 5 wherein said envelope is comprised of glass and said filament support foil is partially embedded in the glass of the envelope by local melting of the glass.

8. The lamp of claim 1 wherein said filament is designed for 230-240 line voltage and said lamp is operated at from 25 to 150 W.

9. The lamp of claim 1 wherein said envelope includes pinch portions located near said end portions, said side filament supports extend within the interior of said envelope in said elliptical portions and do not touch said pinch portions.

10. The lamp of claim 1 wherein said side filament supports are disposed in said elliptical portions of said envelope, and each of said side filament supports is welded to one of said single coil interval portions near said end portions in close proximity to one of said coiled-coil portions of said filament.

11. The lamp of claim 5 wherein the at least one said filament support comprises a single foil welded to said filament or two foils, or a single folded foil, that sandwich said filament therebetween and are welded to said filament.

12. The lamp of claim 1 which is a halogen lamp and said gas comprises an inert gas containing halogen.

13. A lamp comprising:

a light transmissive envelope comprising two connected elliptical portions that together form a hollow interior, a central portion of said envelope between said elliptical portions, each elliptical portion including a major axis and a minor axis, wherein said major axis is between about 12 mm and 17 mm and said minor axis (mm) is approximately equal to 1.2*(major axis −5);

an electrically conductive filament disposed in the interior of said envelope, said filament including coiled-coil portions disposed in said elliptical portions in a coiled-coil shape and a single coil interval portion disposed between said coiled-coil portions at said central portion of said envelope;

sealed end portions of said envelope;

at least one filament support for positioning said filament near a center of said envelope, wherein the at least one said filament support includes side filament supports near said end portions and a central filament support in said central portion of said envelope; and gas contained in the interior of said envelope.

14. The lamp of claim 13 wherein said central portion of said envelope is a cylindrical tube.

15. The lamp of claim 14 wherein said central portion of said envelope is not dunched.

16. The lamp of claim 13 wherein the at least one said filament support is made of tungsten or molybdenum.

17. The lamp of claim 13 wherein the at least one said filament support is a foil.

18. The lamp of claim 17 wherein said foil has a thickness ranging from 0.01 to 0.3 mm.

19. The lamp of claim 17 wherein said filament is welded to said foil.

20. The lamp of claim 17 wherein said envelope is comprised of glass and said foil is partially embedded in the glass of the envelope by local melting of the glass.

21. The lamp of claim 13 wherein said filament is designed for a line voltage of 230-240 volts.

22. The lamp of claim 17 wherein the at least one said filament support comprises a single said foil connected to said filament or two said foils, or a single folded said foil, that sandwich said filament therebetween.

23. The lamp of claim 13 which is a halogen lamp and said gas comprises an inert gas containing halogen.

24. The lamp of claim 3 wherein said central portion of said envelope is not dunched.

* * * * *